US005865501A

United States Patent [19]

Eisenberg et al.

[11] Patent Number: 5,865,501

[45] Date of Patent: Feb. 2, 1999

[54] TABLE AND SEATS FOR CHILDREN

[75] Inventors: Alison Eisenberg, East Aurora; William R. Howell, Chaffee, both of N.Y.

[73] Assignee: Fisher-Price, Inc., East Aurora, N.Y.

[21] Appl. No.: 826,803

[22] Filed: Mar. 25, 1997

[51] Int. Cl.[6] ..... A47B 83/02

[52] U.S. Cl. ..... 297/158.5; 297/157.1

[58] Field of Search ..... 297/157.1, 158.2, 297/158.3, 158.4, 158.5, 159.1, 170, 171; 108/24

[56] References Cited

U.S. PATENT DOCUMENTS

| | | | |
|---|---|---|---|
| 98,298 | 12/1869 | Reichenbach | 297/170 X |
| D. 145,659 | 10/1946 | Covington | 297/170 X |
| D. 152,784 | 2/1949 | Higgins | D33/14 |
| D. 165,710 | 1/1952 | Currie et al. | D33/14 |
| D. 173,910 | 1/1955 | Neuendorf | D33/14 |
| D. 235,394 | 6/1975 | Ruth | D6/45 |
| D. 243,043 | 1/1977 | Rogers | D6/45 |
| D. 265,787 | 8/1982 | Berquist | D6/196 |
| D. 272,302 | 1/1984 | Connely | D6/45 |
| D. 323,074 | 1/1992 | Michel | D6/337 |
| D. 327,177 | 6/1992 | Wehmeyer | D6/337 |
| D. 327,178 | 6/1992 | Ryaa | D6/337 |
| D. 330,127 | 10/1992 | Song | D6/429 |
| D. 354,867 | 1/1995 | Lee | D6/335 |
| D. 369,913 | 5/1996 | Noll | D6/337 |
| 396,089 | 1/1889 | Johnson . | |
| 2,676,646 | 4/1954 | Brashear, Jr. | 297/171 |
| 2,894,561 | 7/1959 | Mackintosh | 155/2 |
| 2,971,656 | 2/1961 | Shoffner | 108/24 |
| 3,223,054 | 12/1965 | Novak | 297/158.5 X |
| 3,572,824 | 3/1971 | Schupbach et al. | 297/157 |
| 3,765,719 | 10/1973 | Silver | 297/170 |
| 3,885,829 | 5/1975 | Haeger | 297/159 |
| 3,910,631 | 10/1975 | Inaba | 297/158.5 |
| 4,052,100 | 10/1977 | Nikitits | 297/158.4 |
| 4,111,482 | 9/1978 | Jones | 297/159 |
| 4,131,311 | 12/1978 | Nikitits et al. | 297/159 |
| 4,330,151 | 5/1982 | Healey | 297/157 |
| 4,607,880 | 8/1986 | Gastebled | 297/158.5 |
| 4,738,484 | 4/1988 | Leong | 297/159 |
| 4,883,314 | 11/1989 | Sakong | 297/159 |
| 4,949,650 | 8/1990 | Allard | 108/146 |
| 5,029,938 | 7/1991 | Song | 297/159 |
| 5,479,852 | 1/1996 | Lloyd | 108/144 |
| 5,556,181 | 9/1996 | Bertrand | 312/313 |

FOREIGN PATENT DOCUMENTS

| | | | |
|---|---|---|---|
| 1031173 | 6/1953 | France | 297/170 |
| 2576196 | 7/1986 | France | A47B 3/14 |

OTHER PUBLICATIONS

Color Photocopy of Picnic Table, "Toys 'R' Us," Germany (date unknown).

*Primary Examiner*—Peter R. Brown
*Attorney, Agent, or Firm*—Morgan, Lewis & Bockius LLP; C. Scott Talbot; Michele Van Patten Frank

[57] ABSTRACT

The present invention includes a table and a plurality of seats that can be coupled together in multiple use configurations and can be easily collapsed into a compact storage unit when not in use. The table includes a table top and a plurality of table legs depending therefrom. In a first use configuration, the table is positioned over the seats with each table leg aligned to engage the seat. Retaining pins extend through apertures formed in the seats and apertures formed in the legs so as to retain the table in position. The retaining pin can be inserted into a second aperture in the leg to retain the table in an extended use configuration. When the pin is withdrawn, the table can be completely removed from the seats for the storage configuration. In the storage configuration, the seats are positioned on the bottom surface of the table top, and the seat legs are aligned to engage recesses formed in the bottom surface of the table top that provide a friction fit. Similarly, when the seat legs are aligned with the recesses in the table top, the table legs are aligned with receiving recesses formed in the bottom of the seat. The engagement of the table legs and seat legs with their respective receiving recesses provides an efficient and effective mechanism for retaining the table in the storage configuration, and advantageously reduces the resultant volume.

19 Claims, 12 Drawing Sheets

TABLE AND SEATS FOR CHILDREN

The present invention relates to furniture and particularly to tables and seats for children. More particularly, the invention relates to a collapsible child's table having a table top selectively coupled to a plurality of seats in multiple use configurations and a storage configuration. In the use configurations, the table top is positioned at various distances above the seats to accommodate growing children. In the storage configuration, the seats nest in the bottom of the table top to provide a compact storage unit.

BACKGROUND OF THE INVENTION

Collapsible tables have been known in the art for years. Typically, conventional collapsible tables include a foldable table top that is coupled to a plurality of seats by a hinge mechanism that allows the seats to fold up under the table top. Once the seats are positioned under the table top, the table top is folded in half to enclose the seats in a closed box-like structure. Such tables have been made out of steel, which tended to make the tables heavy and expensive and provided poor weather resistance. Moreover, such tables were difficult to handle, especially while collapsing the table for storage or unfolding it for use. Accordingly, conventional collapsible tables are not suitable for use as children's furniture.

Various manufacturers have produced children's table furniture. These tables are made out of plastic, which renders them light weight and weather resistant, but they are bulky and cumbersome. Moreover, these tables are typically assembled in a fixed configuration which does not change as the children grow and are therefore quickly outgrown. Also, conventional children's tables are assembled using bolts and screws to hold the constituent parts together, and are not easily collapsed into a compact storage unit when not in use. Moreover, once the table has been disassembled, the fasteners (bolts and screws) must be put aside until the table is needed again, which is inconvenient. Even if the fasteners are stored with the table, they must be accounted for to prevent their possible loss.

To overcome the storage problem, some tables include seats that are pivotally attached to the table legs. In the storage mode, the seats swing about the legs to positions under the table top. Unfortunately, this provides only a minimum reduction of the amount of space required.

SUMMARY OF THE INVENTION

The present invention overcomes these problems by providing a durable, light-weight, weather resistant table that expands to accommodate growing children so that it is not easily outgrown. The present invention includes a table and a plurality of seats that can be coupled together in multiple use configurations and can be easily collapsed into a compact storage unit when not in use.

The table includes a table top and a plurality of table legs depending therefrom. The seats include a bench, a receiver formed in the bench, and a pair of seat legs depending from the bench. In a first use configuration, the table is positioned over the seats with each table leg aligned with a receiver. The table is lowered into the benches so that the table legs are received in the receivers. Retaining pins extend through apertures formed in the receivers that are aligned with apertures formed in the leg so as to retain the table in position. As the children grow, the pin can be withdrawn from the table legs and the table can be lifted to raise the legs in the receivers. The retaining pin can be inserted into a second aperture in the leg to retain the table in an extended use configuration.

When the pin is pulled back to its stopping position, the table can be completely removed from the seats for the storage configuration. The seats are positioned on the bottom surface of the table top, and the seat legs are aligned to engage recesses formed in the bottom surface that provide a friction fit. Similarly, when the seat legs are aligned with the recesses in the table top, the table legs are aligned with receiving recesses formed in the bottom of the bench. The engagement of the table legs and seat legs with their respective receiving recesses provides an efficient and effective mechanism for retaining the table in the storage configuration, and advantageously reduces the resultant volume.

DETAILED DESCRIPTION OF THE DRAWINGS

Figure 1:
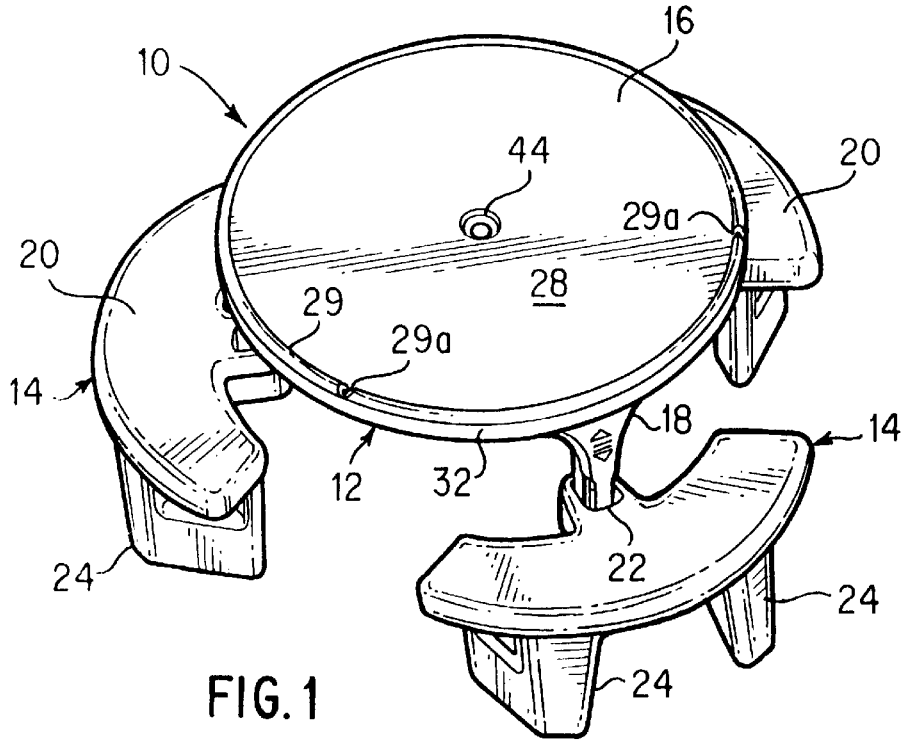
FIG. 1 is a top perspective view of a first embodiment of a table and seat combination shown in a use configuration.
Figure 2:
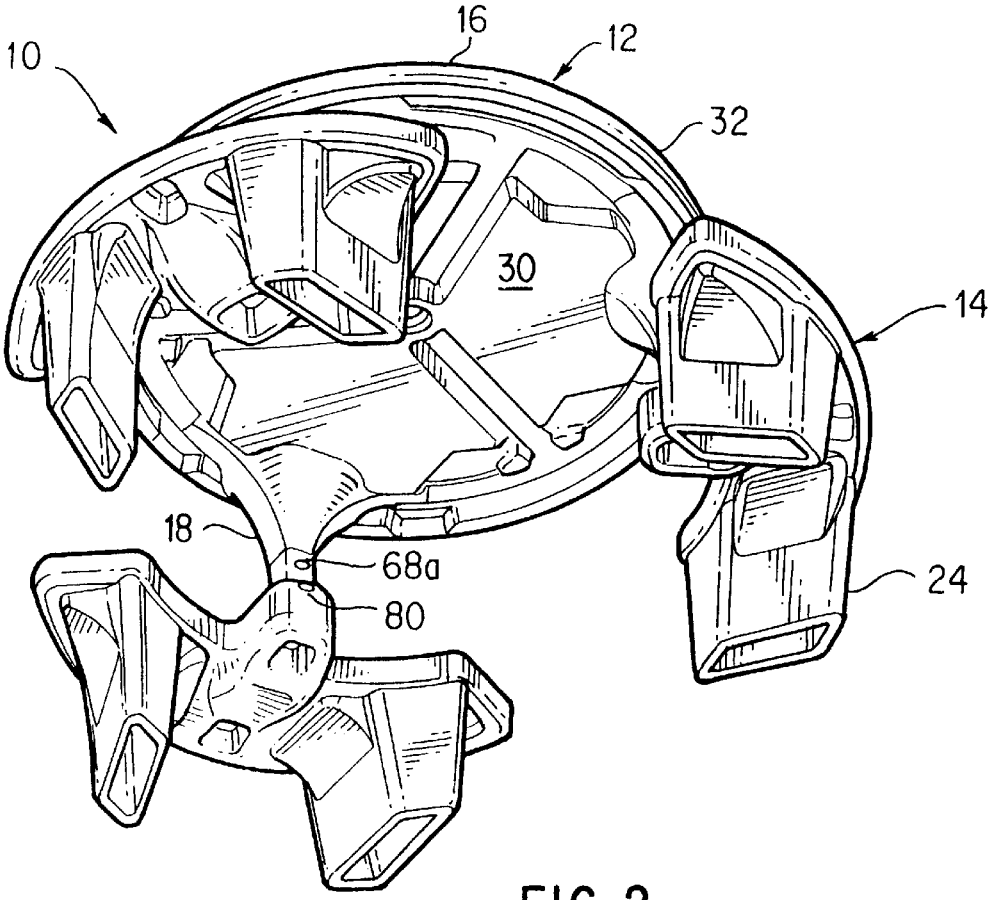
FIG. 2 is a bottom perspective view of the table and seat combination of FIG. 1.
Figure 3:
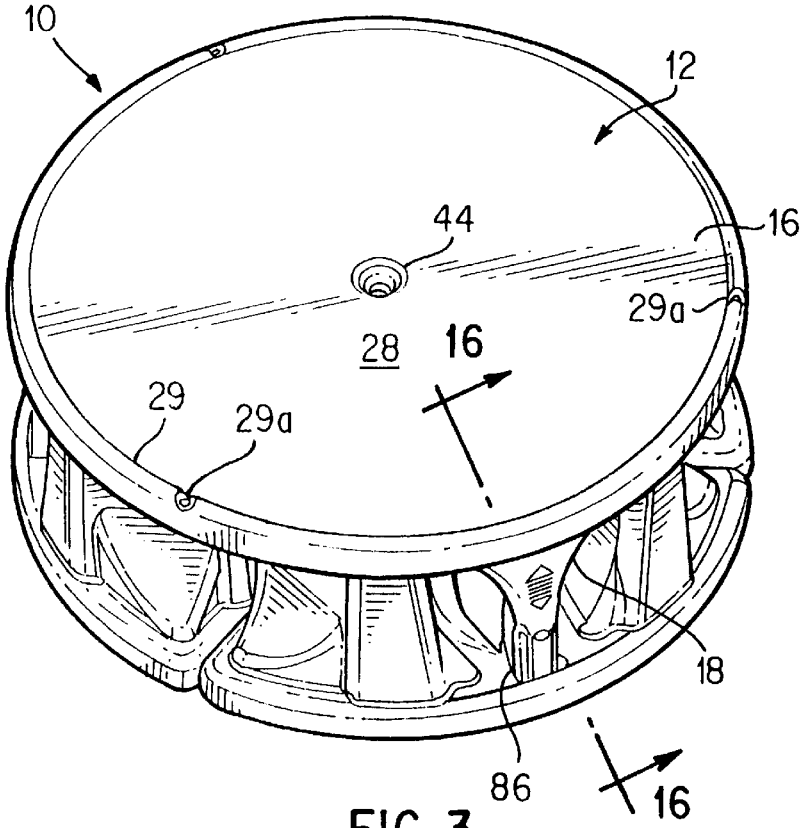
FIGS. 3 and 4 are top and bottom perspective views, respectively, of the table and seat combination of FIG. 1 arranged in a storage configuration.
Figure 4:
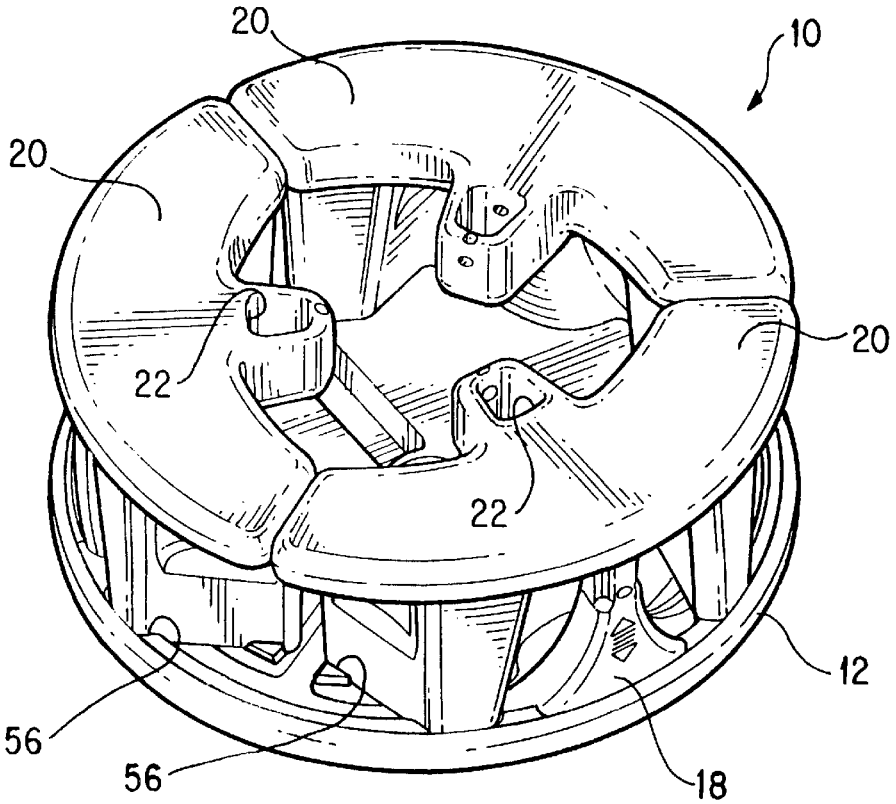

A first embodiment of a table and seat combination 10 is illustrated in FIGS. 1–16. The table and seat combination 10 includes a circular table 12 and three arcuate seats 14. The table 12 can be coupled to the seats 14 in two use configurations (at different spacings between the table's top surface and the seat's upper seating surfaces) to accommodate children in different age ranges. The table and seat combination 10 is shown in a use configuration in FIGS. 1 and 2. The seats 14 can also be stored in an inverted orientation on the lower surface of table 12 to form a storage configuration (as shown in FIGS. 3 and 4). The table 12 includes a table top 16 and three legs 18 depending from the table top 16. Each seat 14 includes a bench 20, a receiver 22 formed in the bench 20, and a pair of legs 24 depending from the bench 20.

Figure 5:
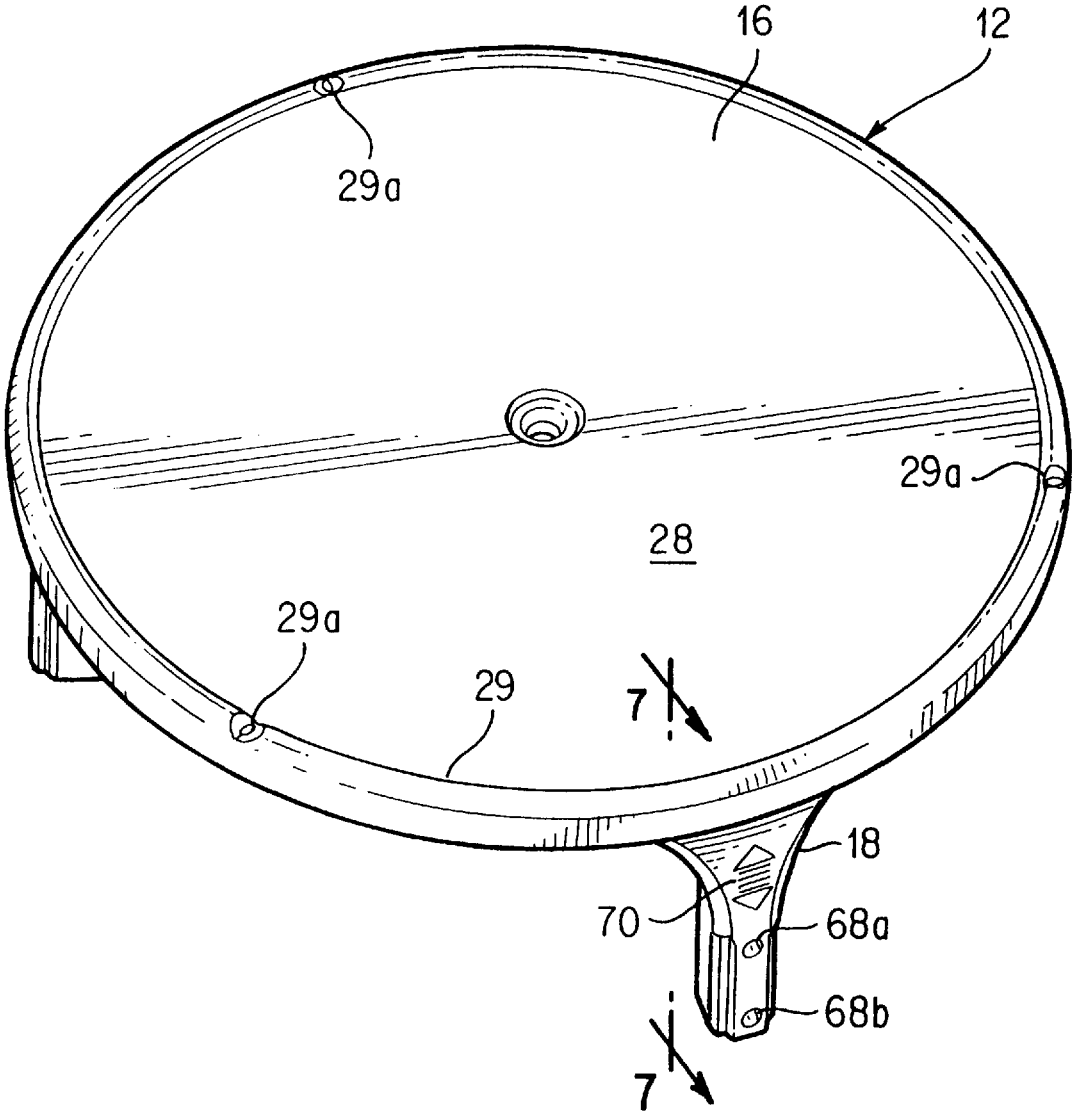
FIGS. 5 and 6 are top and bottom perspective views, respectively, of the table of FIG. 1.
Figure 6:
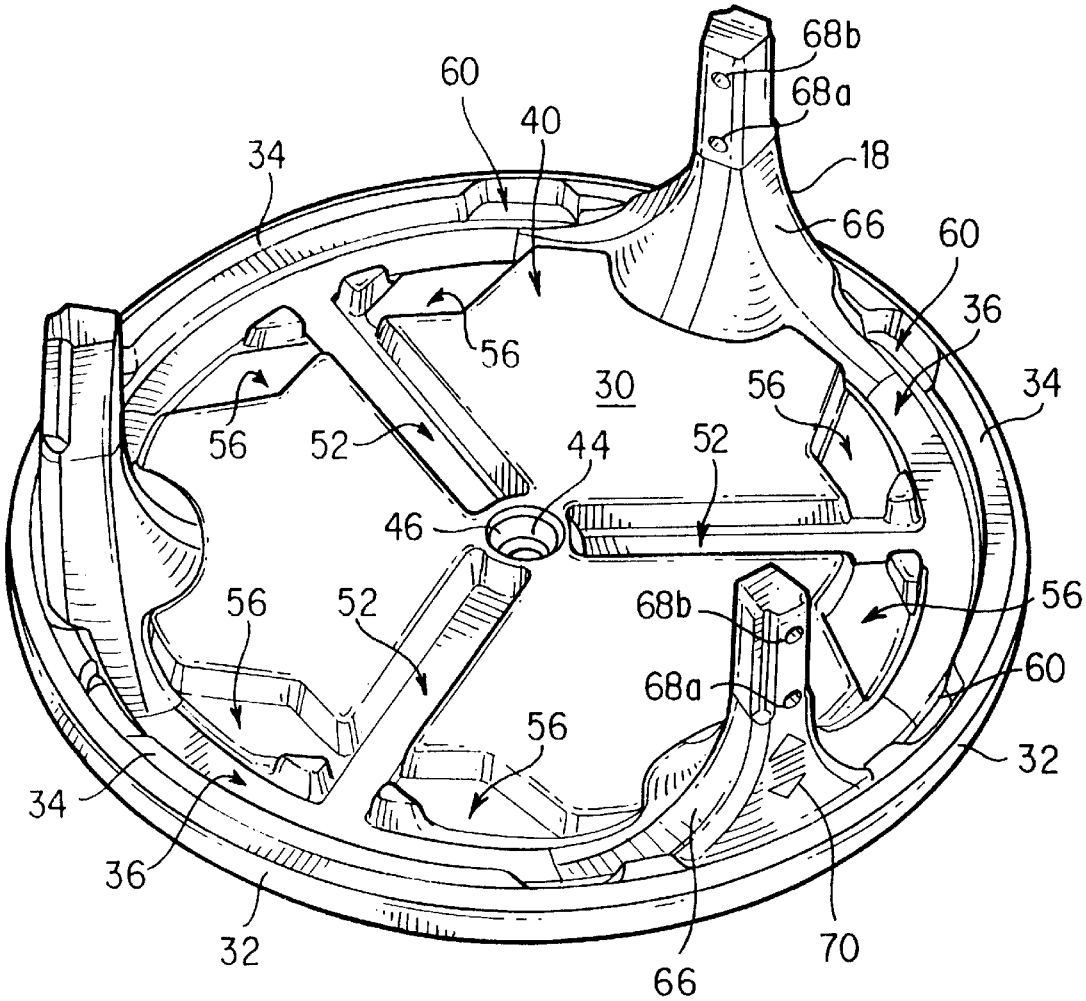

As illustrated in FIGS. 5 and 6, the table top 16 includes an upper surface 28 and a lower surface 30 that are connected by an outer edge 32. The upper surface 28 slopes radially outwardly and downwardly to provide a liquid-shedding slope and preferably includes a peripheral lip 29, illustrated in FIG. 7. A plurality of channels 29*a* are formed in the peripheral lip 29 to aid in run-off of rain or liquids spilled on the table 12.

The lower surface 30 defines an annular rim 34, extending radially inwardly from the outer edge 32, and an annular recess 36 disposed immediately adjacent the annular rim 34. The annular recess 36 surrounds a central disk 40 that includes a central aperture 44 having a sidewall 46 that extends between and connects the upper and lower surfaces 28, 30, respectively. The sidewall 46 provides structural rigidity to the table top 16, and the aperture 44 serves an alternative purpose of receiving an umbrella pole. A plurality of recesses 52 extend radially outwardly from adjacent the central aperture 44 to the annular recess 36, and serve as structural ribs to further stiffen table top 16. A pair of leg-receiving recesses 56 span each junction of a radial recess 52 and the annular recess 36. The specific shape and location of the leg-receiving recesses 56 is determined by the shape and location of the seat legs 24 so as to provide a friction fit with the seat legs 24. In the illustrated embodiment, the leg-receiving recesses 56 are generally parallelograms and extend at an angle from the radial recess 52 through the annular recess 36 into the annular rim 34. Advantageously, the portion of the leg-receiving recess 56 formed in the annular rim 34 forms a convenient hand hold 60 for grasping the table 12.

The table legs 18 extend from the annular rim 34 and the annular recess 36 and include strengthening fillets 66 that extend away from the legs 18 into the annular recess 36 and onto the central disk 40. A plurality of retaining pin-receiving apertures 68*a*, 68*b* extend radially through each leg 18 toward the center of the table 10. In preferred embodiments, each leg 18 further includes indicia 70 for indicating upward and downward movement of the table 12 relative to the seats 14.

Figure 8:
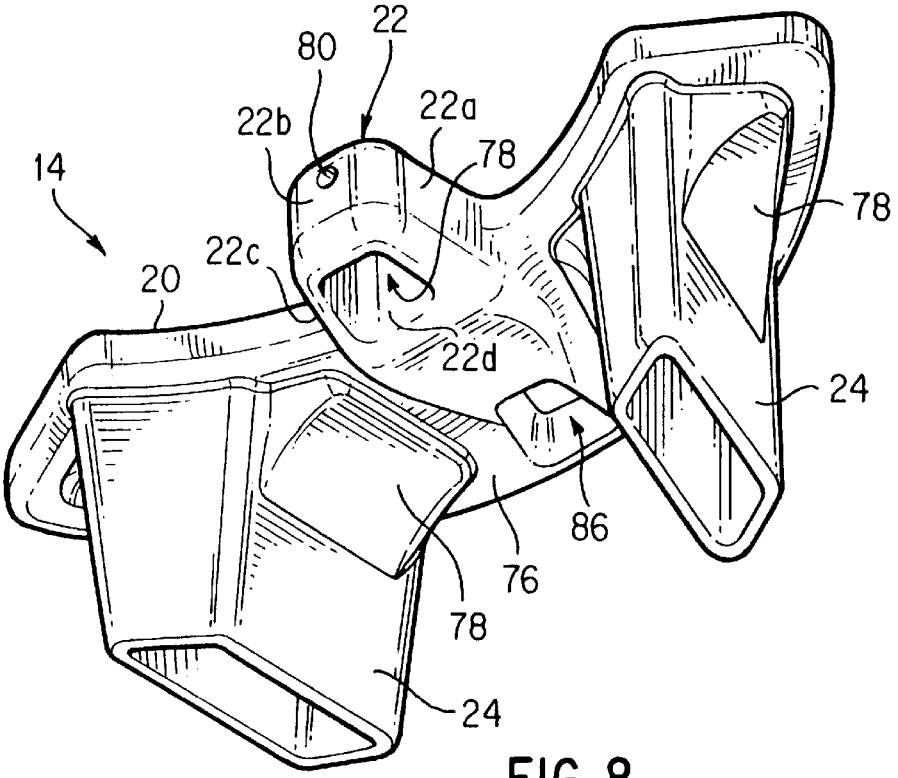
FIGS. 8 and 9 are bottom and top perspective views, respectively, of one of the seats of the table and seat combination of FIGS. 1.
Figure 9:
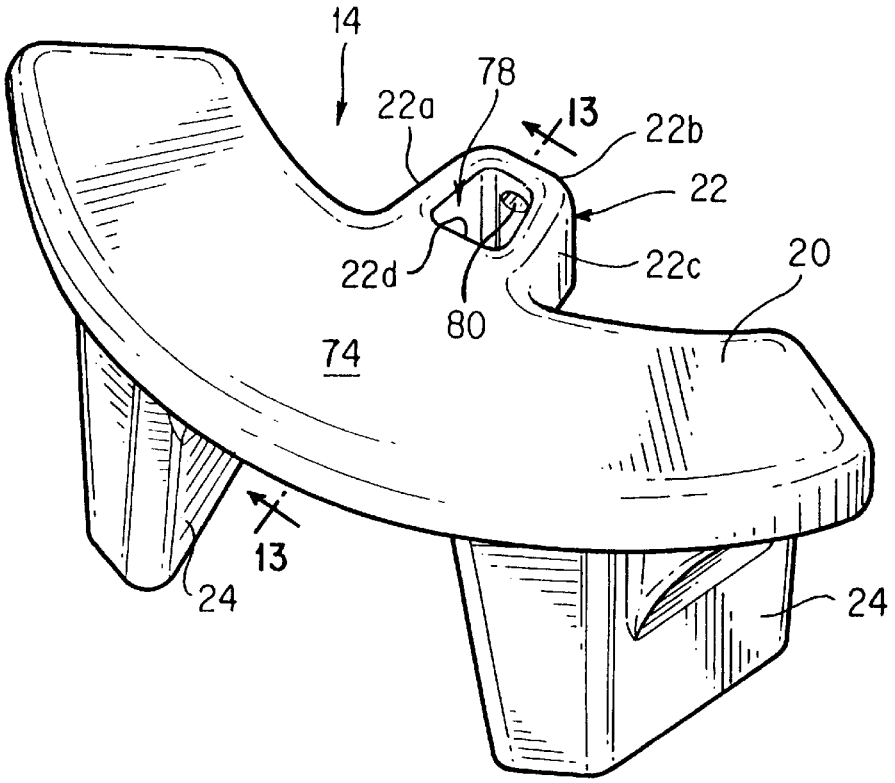

As illustrated in FIGS. 8 and 9, each seat 14 includes a bench portion 20 having an upper surface 74, a lower surface 76, and a receiver 22 extending outwardly in the plane of the bench 20. The receiver 22 includes a plurality of sidewalls 22*a*, 22*b*, 22*c*, 22*d* that cooperate to define a vertically-oriented leg-receiving aperture 78 for receiving a table leg 18. A retaining pin-receiving aperture 80 extends through sidewalls 22*b* and 22*d* for receiving a retaining pin 82, as shown in FIGS. 10–16. A keeper 84 extends downwardly through the upper surface 74 into sidewall 22*b* to engage and keep the retaining pin 82 in the pin-receiving aperture 80, as shown in FIGS. 13–16. The keeper 84 is preferably a nail driven through the upper surface 74.

The lower surface 76 includes a table-leg receiving recess 86. The recess 86 extends into, but not through, the bench 20 and is sized and shaped to provide a friction fit with the foot of a table leg 18. A pair of seat legs 24 depend from the lower surface 76 and include strengthening fillets 78 extending outwardly from either side of the legs to the lower surface 76.

Figure 10:
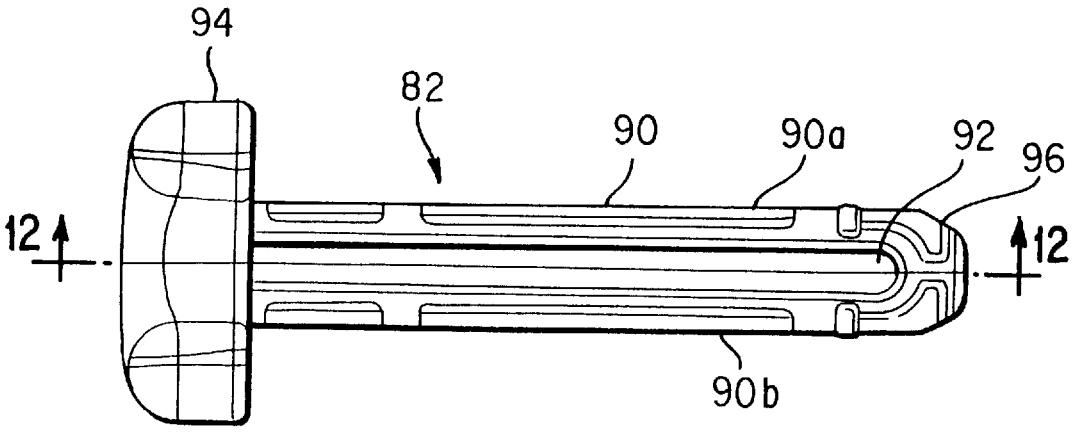
FIGS. 10 and 11 are top and side views, respectively, of a first embodiment of a retaining pin of the table and seat combination of FIG. 1.
Figure 11:
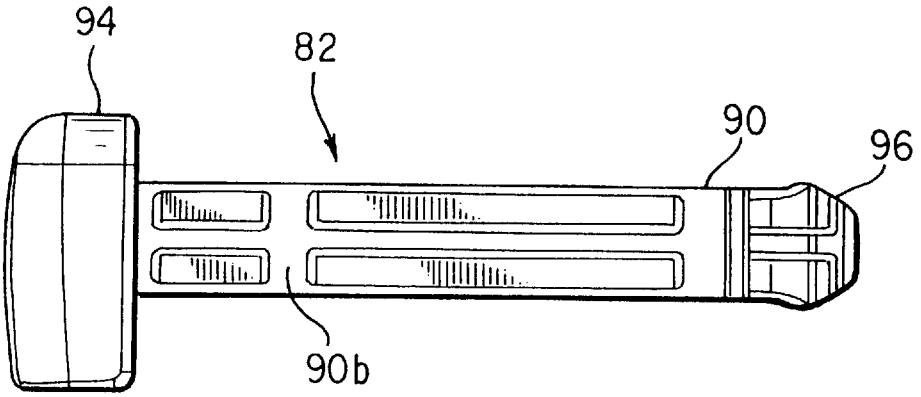
Figure 12:
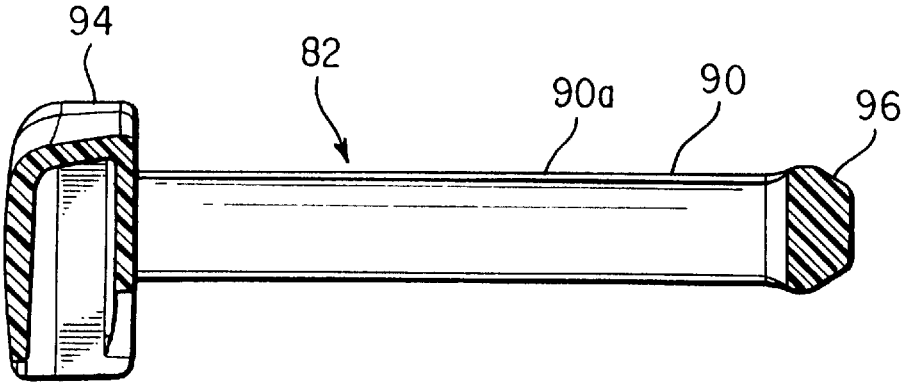
FIG. 12 is a vertical section view of the retaining pin of FIGS. 10 and 11, taken along line 12—12 of FIG. 10.
Figure 13:
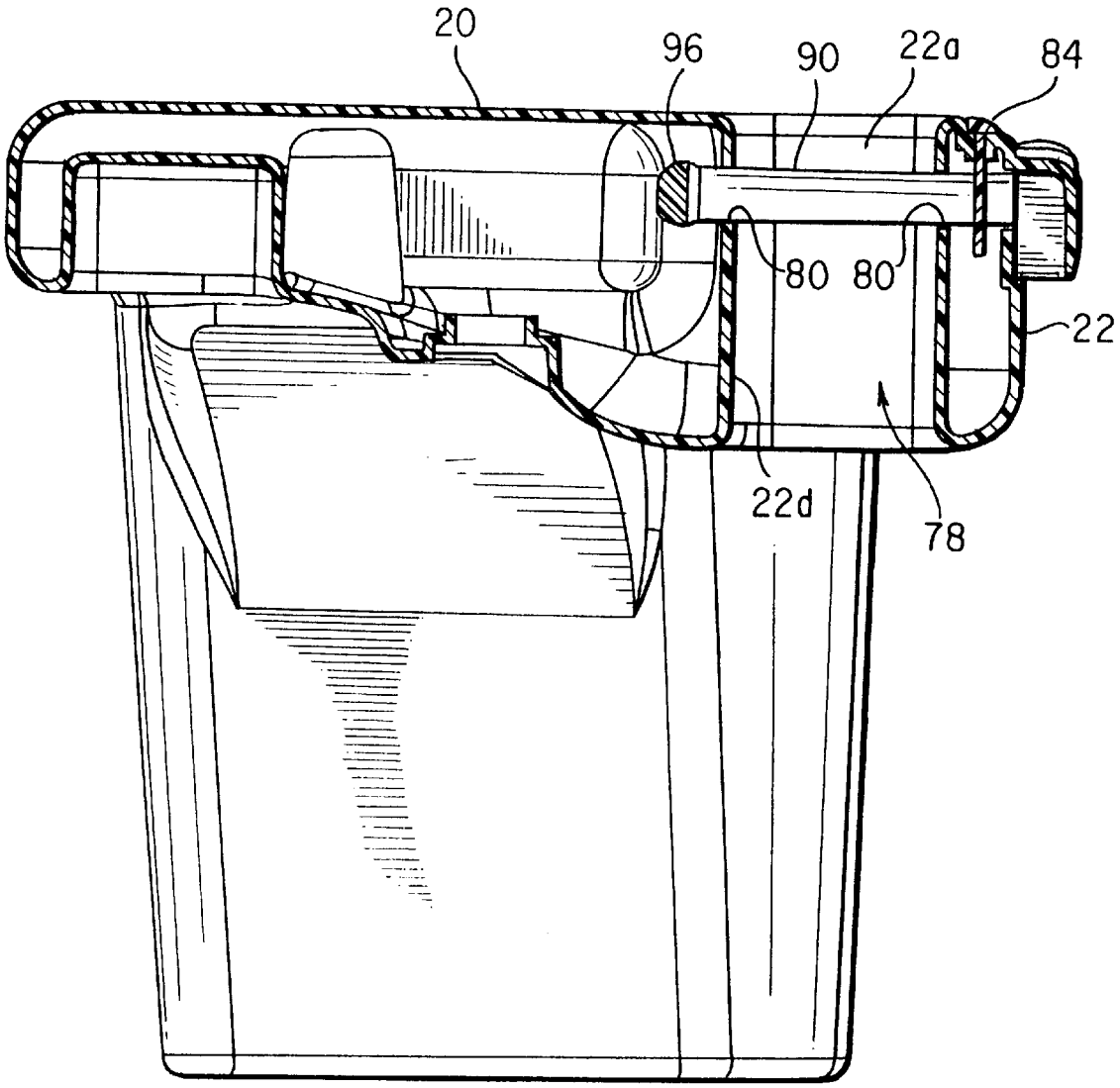
FIG. 13 is a vertical section view of the seat of FIGS. 8 and 9, taken along line 13—13 of FIG. 9, with a retaining pin installed.

A retaining pin 82, as illustrated in FIGS. 10–12, includes a longitudinally extending shaft 90 having a pair of sidewalls 90*a*, 90*b* joined at a distal end by solid tip 96 and defining a slot 92 therebetween. The solid tip 96 closes the slot 92 and is slightly enlarged relative to the shaft to provide an interference fit with the pin-receiving aperture 80 to assist in retaining the pin 82 in the receiving aperture 80. Retaining pin 82 further includes a handle 94 at a proximal end of shaft 90. The user can pull the pin radially outwardly, and push the pin radially inwardly, in the pin-receiving aperture 80 by grasping handle 94. The pin is retained the in the pin-receiving aperture by engagement of the keeper 84 with slot 92.

Figure 14:
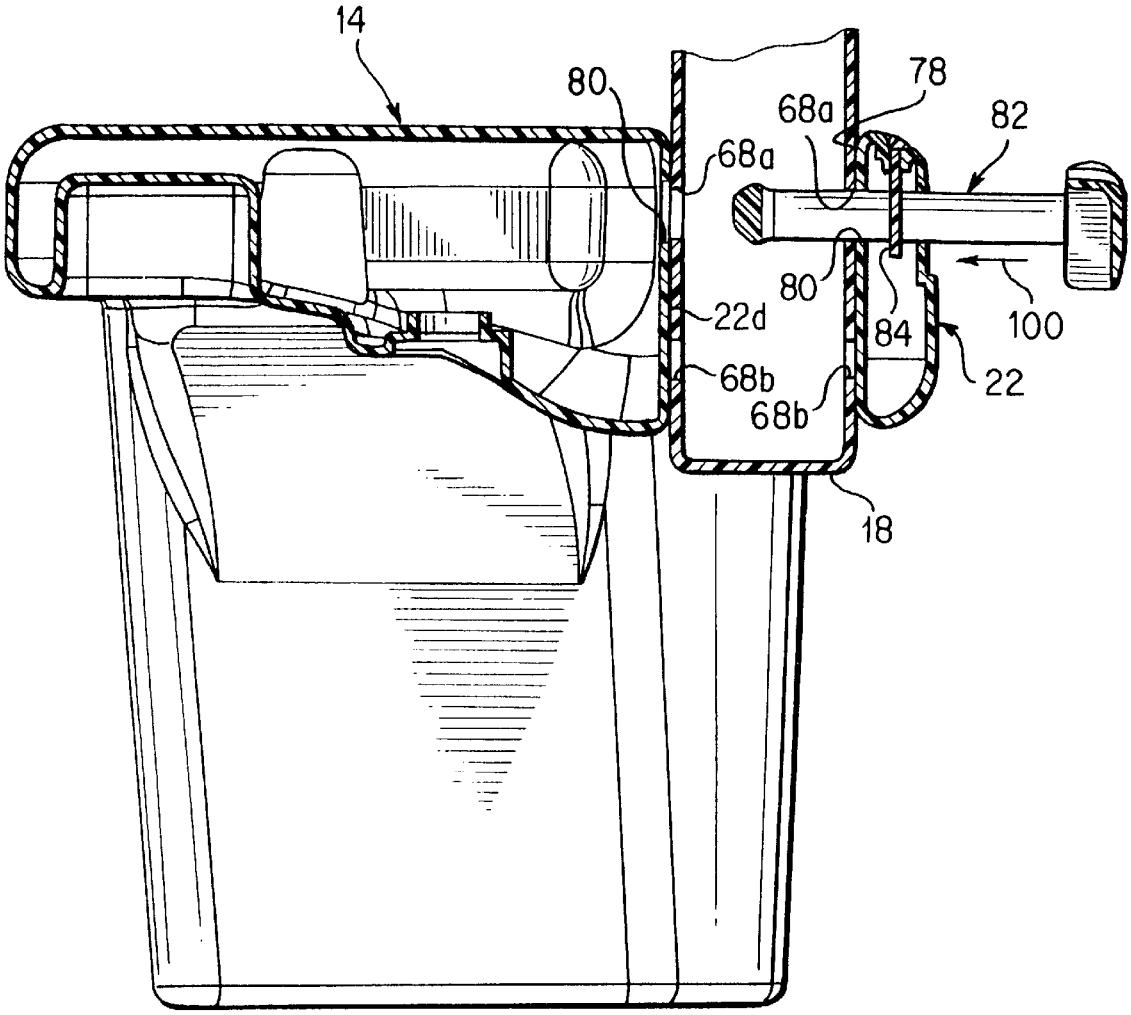
FIG. 14 is similar to FIG. 13 with a table leg disposed in the seat in a first use configuration.
Figure 15:
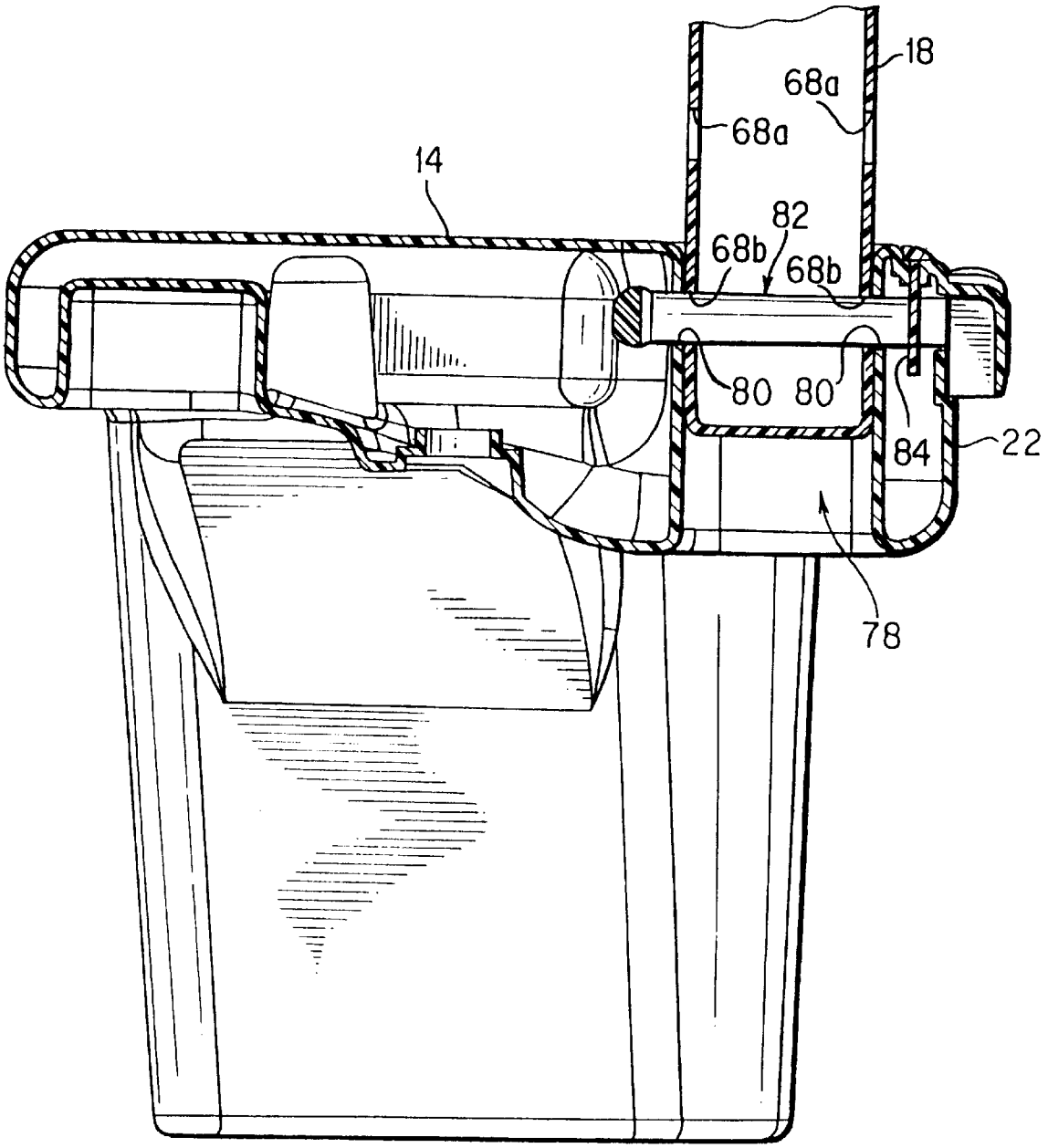
FIG. 15 is similar to FIG. 14 with the table leg engaging the seat in an second use configuration.

In the use configuration, the seats 14 are arranged in a circle and the table 12 is disposed to position the table legs 18 in receivers 22 as illustrated in FIGS. 14–15. The table leg 18 includes a plurality of pin-receiving apertures 68*a*, 68*b* that can be aligned with the pin-receiving apertures 80 in the receiver 22. Depending on the size of the children using the table and seat combination 10, the table leg 18 can be dropped into the receiver 22 to align a selected leg aperture 68 with the receiver aperture 80 to set the table top 12 at a selected height above the benches 20. Once the apertures 80, 68 have been aligned, the retaining pin 82 is inserted therethrough to lock the table top 12 in the selected use configuration.

For example, when smaller children are going to use the table and seat combination 10, the table top 12 is positioned with the upper leg pin-receiving aperture 68*a* aligned with the receiver pin-receiving aperture 80, as illustrated in FIG. 14, to provide a first use configuration. The retaining pin 82 is moved in the direction of arrow 100 so as to pass through the aperture in sidewall 22*d* and thereby hold the table leg 18 in position relative to the seat 14. As the children grow, the height of the table top 16 above the seats 14 can be increased by simply pulling the retaining pin 82 back to clear the apertures 80, 68*a*, raising the table top 12 to align apertures 80 and 68*b*, and pushing the retaining pin 82 through the apertures 80, 68*b* to lock the table top in the new use configuration, as illustrated in FIG. 15.

Figure 16:
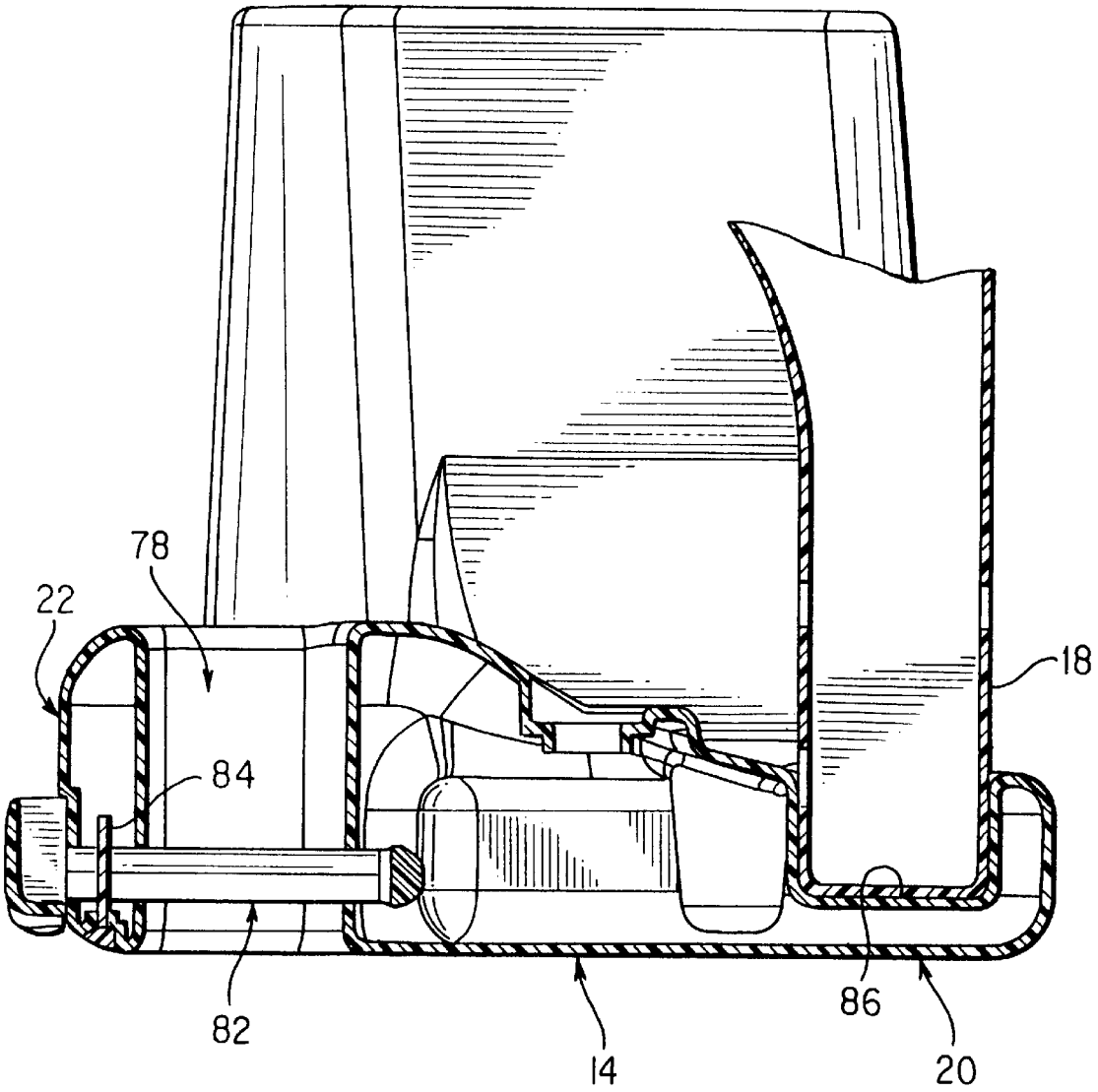
FIG. 16 is a partial vertical section view of the seat and table combination of FIG. 3, taken along line 16—16 of FIG. 3.
Figure 19:
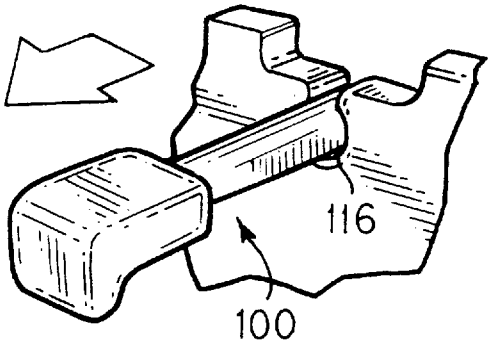
FIG. 19 shows the pin of FIG. 17 inserted into the aperture of FIG. 18.

In the storage configuration, the table top 12 and seats 14 are inverted relative to each other, as illustrated in FIGS. 3 and 4. As illustrated in FIG. 16, the table legs 18 are inserted into the table leg-receiving recesses 86 formed in the bottom surface of the benches 20. In a similar fashion, the seat legs 24 are inserted into the seat leg-receiving recesses 56 formed in the bottom of the table top 16. The recesses 86, 56 are sized to provide a friction fit with the table legs 18 and seat legs 24, respectively, to retain the table top 12 and seats 14 in the storage configuration. When in the storage configuration, the table and seat combination 10 can be readily moved from place to place by rolling it on its side.

Figure 7:
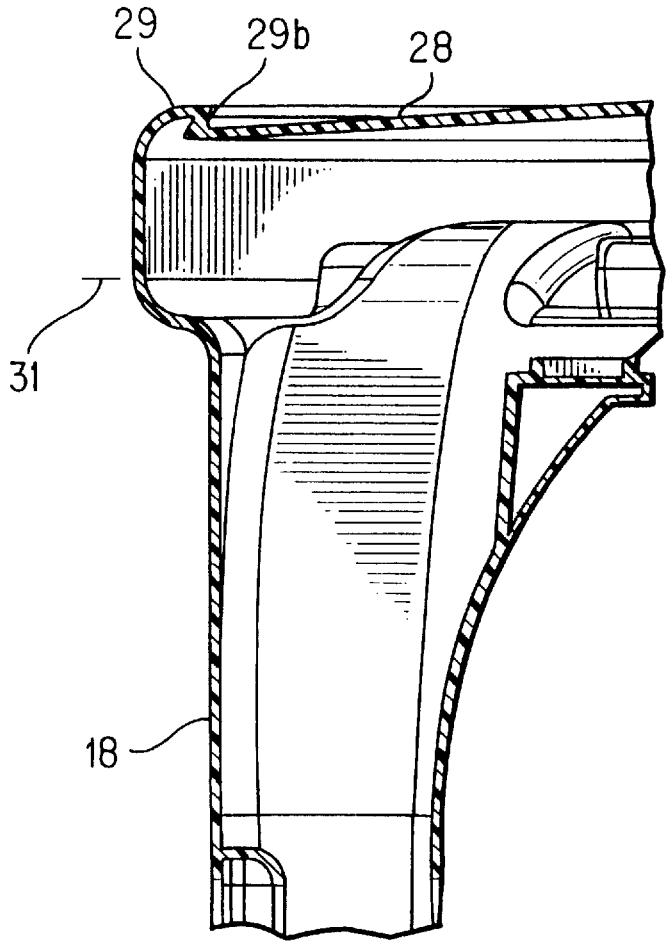
FIG. 7 is a vertical section view of a portion of the edge of the table top illustrating an undercut taken along line 7—7 of FIG. 5.

In the illustrated embodiment, the table 12 and the seats 14 are rotationally molded from low density polyethylene (LDPE). In addition to the liquid runoff control function described above, the peripheral lip 29 also aids in the manufacturing of the table 12. The parting line 31 of the mold flask (not shown) lies in a horizontal plane cutting through the table. When the mold flask is opened, the table will adhere more strongly to either the top or bottom of the flask. If the table stays with the bottom of the flask, the table legs will be hidden inside the flask and there will be no hand-holds available. Accordingly, the table will have to be pried out of the mold, which takes additional time, slowing the molding process, and can mar or destroy the table top. If, on the other hand, the table stays with the top of the flask, the table legs will project out of the flask and provide a ready hand-hold to pull the table out of the mold. The lip 29 provides the means for retaining the table top in the top of the mold flask. In particular, the lip 29 provides an undercut 29*b* that grips the mold flask above the parting line of the mold. The undercut 29*b* is best illustrated in FIG. 7 and includes a projection extending radially inwardly from the lip 29 that engages a complementary projection formed in the mold flask. The engagement is sufficient to overcome any adherence between the legs and the mold flask.

In the illustrated embodiment, the retaining pin 82 is injection molded from polypropylene. Of course, the artisan will recognize that other fabrication techniques may be used and that other materials may be selected.

Figure 17:
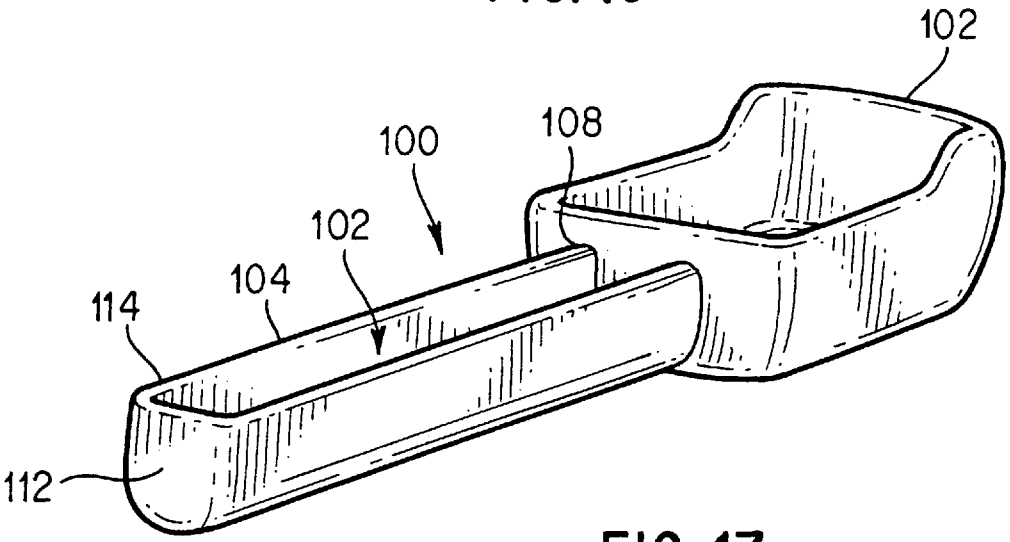
FIG. 17 is a perspective view of an alternative embodiment of the retaining pin.
Figure 18:
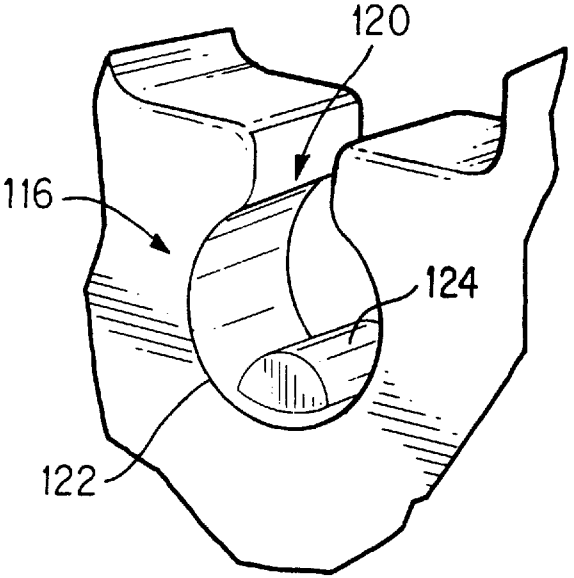
FIG. 18 is a perspective view of an alternative embodiment of a pin-receiving aperture for use with the retaining pin of FIG. 17.

An alternative embodiment of the retaining pin is illustrated in FIGS. 16–18. The retaining pin 100 functions the same as the retaining pin 82 to retain the table top 12 in position relative to the seats 14. That is, it is inserted through the aligned apertures in the receiver 22 and table legs 18. However, the retaining pin 100 includes a handle 102, a shaft 104 coupled to the handle 102 at a proximal end 108 and a generally U-shaped channel 106 extending longitudinally along the shaft 104. The channel 106 terminates at the handle 102 at the proximal end 108 and at an end wall 112 at the distal end 114.

The pin 100 is designed for use with an alternative embodiment of the pin-receiving aperture 116, illustrated in FIG. 17. The alternative pin-receiving aperture 116 includes an access slot 120 that opens into a generally circular aperture 122. The diameter of the circular aperture 122 is substantially equal to the diameter of the shaft 104. An inverted U-shaped projection 124 is formed in the sidewall of the aperture 116 and is sized to accommodate the U-shaped channel 106. In operation, the pin 100 is forced through the slot 120 and aligned to engage the projection 124 with the channel 102. The pin 100 is then free to move longitudinally over the projection 124 between the handle 106 and the end wall 112.

What is claimed is:

1. An article of furniture convertible back and forth between a use configuration and a storage configuration, comprising:

at least one bench having a bench exterior contour with opposing surfaces having a first table top engagement portion on one bench surface and a second table top engagement portion on the opposing bench surface; and a table top having a table top exterior contour with a first bench engagement portion formed in said table top exterior contour and a second bench engagement portion, apart from said first bench engagement portion, formed in said table top exterior contour, wherein said first table top engagement portion of said bench engages said first bench engagement portion of said table top in the use configuration, and in the storage configuration, said first table top engagement portion disengages from said first bench engagement portion, and said second table top engagement portion of said bench cooperatively engages said second bench engagement portion of said table top.

2. The article of furniture according to claim 1, wherein said first table top engagement portion is an aperture and said first bench engagement portion is a table leg projecting outwardly therefrom, wherein said table leg is received in said aperture of said bench in the use configuration and in the storage configuration, said table leg is disengaged from said aperture.

3. An article of furniture according to claim 2, further comprising:

an adjustment mechanism engageable with said bench and said table leg, wherein said table leg is slidably disposed in said aperture of said bench and is slidable between a first height and a second height and said adjustment mechanism secures said table top at one of said first height and said second height.

4. An article of furniture according to claim 3, wherein said adjustment mechanism comprises a locking pin and said bench adjacent said aperture has a first opening and said table leg has a second opening alignable with said first opening and adapted to receive said locking pin.

5. An article of furniture according to claim 4, wherein one of said table leg and said bench has a third opening and one of said first and second openings, respectively, is alignable with said third opening to receive said locking pin.

6. The article of furniture according to claim 1 wherein said first bench engagement portion is a table leg and said second bench engagement portion is a recess and said table leg engages said first bench engagement portion of said table top in the use configuration, and in the storage configuration said first table top engagement portion disengages from said table leg and said second table top engagement portion of said bench cooperatively engages said recess.

7. The article of furniture according to claim 1, wherein said first table top engagement portion is an aperture and said second table top engagement portion is a recess, wherein said aperture of said bench is engaged by said first bench engagement portion of said table top in the use configuration and in the storage configuration, said aperture is disengaged from said first bench engagement portion of said table top, and said recess of said bench cooperatively engages said second bench engagement portion of said table top.

8. The article of furniture according to claim 1, wherein said bench includes a seat and a support member extending therefrom.

9. The article of furniture according to claim 1, wherein said table has a peripheral edge defining an outer most perimeter and said bench does extend beyond said outer most perimeter in the storage configuration.

10. The article of furniture according to claim 1, wherein said second bench engagement portion of said table top is a table top recess and said second table top engagement portion is a bench support member, and in the storage configuration said bench support member cooperatively engages said table top recess.

11. The article of furniture according to claim 1, wherein said table top has a circular shape and said bench has an arcuate shape.

12. An article of furniture according to claim 1, wherein said at least one bench comprises three benches.

13. The article of furniture according to claim 1, wherein said table top includes a sloping upper surface and a peripheral lip extending upwardly from the upper surface.

14. An article of furniture, comprising:

at least one bench including a seat with a seat surface and an undersurface and a support member extending away from said undersurface wherein said bench has an undersurface with a first recess; and a table top including an upper table surface and a lower surface including a table leg and a second recess, wherein said first recess of said bench is adapted to receive and retain said table leg and said second recess of said table top is adapted to receive and retain said support member of said bench in a compact storage configuration, whereby said seat surface faces in a first direction and said table surface faces in a second direction opposite said first direction.

15. An article of furniture, according to claim 14, wherein said table top has a circular shape and said bench has an arcuate shape.

16. An article of furniture convertible between a use configuration and a storage configuration, comprising:

a table having a table top, a lower table surface including a plurality of recesses and a plurality of table legs depending from said table top; and a plurality of seats each including a seating surface, a table leg attachment means and a leg depending from each of said seats, wherein said table leg attachment means on said seats are attachable to said table legs in the use configuration whereby said seating surface faces toward said table top and said seats are attachable to said table top in the storage configuration, whereby said seating surface faces away from said table top and said leg of each of the seats are received one each in the recesses on the lower table surface.

17. An article of furniture convertible between a use configuration and storage configuration, comprising:

a table having a table top and a plurality of legs depending from the table top; and a plurality of seats each including a seating surface and a lower surface, each of the seating surfaces including a first aperture for detachably receiving one of said plurality of table legs in the use configuration and each of said lower surfaces including a recess for receiving one of said plurality of table legs in the storage configuration, wherein said seating surfaces face toward said table top in the use configuration and said seating surfaces face away from said table top in the storage configuration.

18. An article of furniture convertible between a use configuration and a storage configuration, comprising:

a table including a table top having an upper table surface, a lower table surface with a first recess and a plurality of table legs depending from said lower table surface; and a plurality of seats each including a seating surface, a table leg attachment means and a lower surface with a second recess and at least one seat leg depending from said lower surface, wherein said table leg attachment means on said seats are attached to said table legs in the use configuration, whereby said seating surface faces toward said table top and said seats are attachable to said table top in the storage configuration, whereby each of said plurality of table legs engages said second recess formed in said lower surface of the said seat and each of said at least one seat legs engage said first recess formed in said lower table surface.

19. An article of furniture convertible between a use configuration and a storage configuration, comprising:

table top including a lower table surface having a plurality of recesses and a plurality of table legs depending from said table top; and a plurality of seats each including a seating surface and a table leg attachment means, wherein said table leg attachment means on said seats are attachable to said table legs in the use configuration and said seating surface face toward said table top and said seats are attachable to said lower table surface in the storage configuration with each of said plurality of seats engaging at least one of said plurality of recesses and said seating surface faces away from said table top.

* * * * *